US006168462B1

(12) United States Patent
Liao

(10) Patent No.: US 6,168,462 B1
(45) Date of Patent: Jan. 2, 2001

(54) CONNECTOR STRUCTURE

(76) Inventor: Wen Jung Liao, 5F, No. 201-12, Chung Cheng Rd., Hsintien, Taipei Hsien (TW)

( * ) Notice: Under 35 U.S.C. 154(b), the term of this patent shall be extended for 0 days.

(21) Appl. No.: 09/122,067

(22) Filed: Jul. 24, 1998

(51) Int. Cl.[7] ..... H01R 13/66
(52) U.S. Cl. ..... 439/541.5; 439/79
(58) Field of Search ..... 439/76.1–76.2, 439/78–80, 82–3, 100, 101, 607–610, 636, 637, 638, 639, 540.1, 541.5, 587

(56) References Cited

U.S. PATENT DOCUMENTS

D. 411,174 * 6/1999 Huang ..... 439/540.1
5,336,109 * 8/1994 Hillbish et al. ..... 439/540.1
5,695,362 * 12/1997 Hillbish et al. ..... 439/541.5
5,823,822 * 10/1998 Tan et al. ..... 439/540.1
5,851,125 * 12/1998 Hsu et al. ..... 439/541.5

* cited by examiner

*Primary Examiner*—Lincoln Donovan
(74) *Attorney, Agent, or Firm*—Rosenberg, Klein & Lee

(57) ABSTRACT

A connector structure includes an insulating body defining a plurality of connector housings integrally combined each with the other within the insulating body, a plurality of conducting terminals, and a seat removably secured at one end of the insulating body. Each connector housing has a plurality of respective channels, while the seat is provided with first and second terminal grooves extending at respective areas of the seat. Conducting terminals of each connector are installed in the insulating body with connector portions of the conducting terminals extending through channels of a respective connector and with the tail portions of the conducting terminals passing through respective terminal grooves defined through the seat. The overall structure, due to the integral formation of a plurality of the connector housings within the single insulating body is simple in assembling, as well as low in manufacturing cost.

3 Claims, 6 Drawing Sheets

CONNECTOR STRUCTURE

BACKGROUND OF THE INVENTION

1. Field of the Invention

The present invention relates to a connector structure, and specifically, to a connector structure for integrating various connectors in a single unit that may greatly reduce the cost of manufacturing and finishing of the structure.

2. Description of the Prior Art

In a prior art connector structure, connectors of various types are integrated into an assembling body, as described in Taiwan Patent Nos. 323857 and 334185. In the prior connectors, an insulating body is divided into a first body and a second body, and a first connector and a second connector of different types are combined into the first body and the second body, respectively. Therefore, as the connector is combined with a printed circuit board, it occupies a minimum space.

In the prior connector structure, individual insulating housings of the first connector and the second connector are assembled on the insulating body. The combined structure is relatively complex and is difficult to assemble. Another drawback is that the insulating housings of the first connector and the second connector are manufactured by separate moulding processes, thus making manufacturing and finishing cost-consuming, and the updating and maintenance of components difficult and time- and labor-consuming.

SUMMARY OF THE INVENTION

A connector structure comprises an insulating housing, a seat, a first connector and a second connector. The insulating housings of the first connector and the second connector are integrally formed in the insulating body so that the whole structure is simplified and is simple in assembling. Thus the cost of the overall module, manufacturing, and finishing is greatly reduced. The maintenance and updating of the components are easily performed.

The present invention will be better understood and its numerous objects and advantages will become apparent to those skilled in the art by referencing to the following drawings in which:

DETAILED DESCRIPTION OF THE PREFERRED EMBODIMENT

Figure 1:
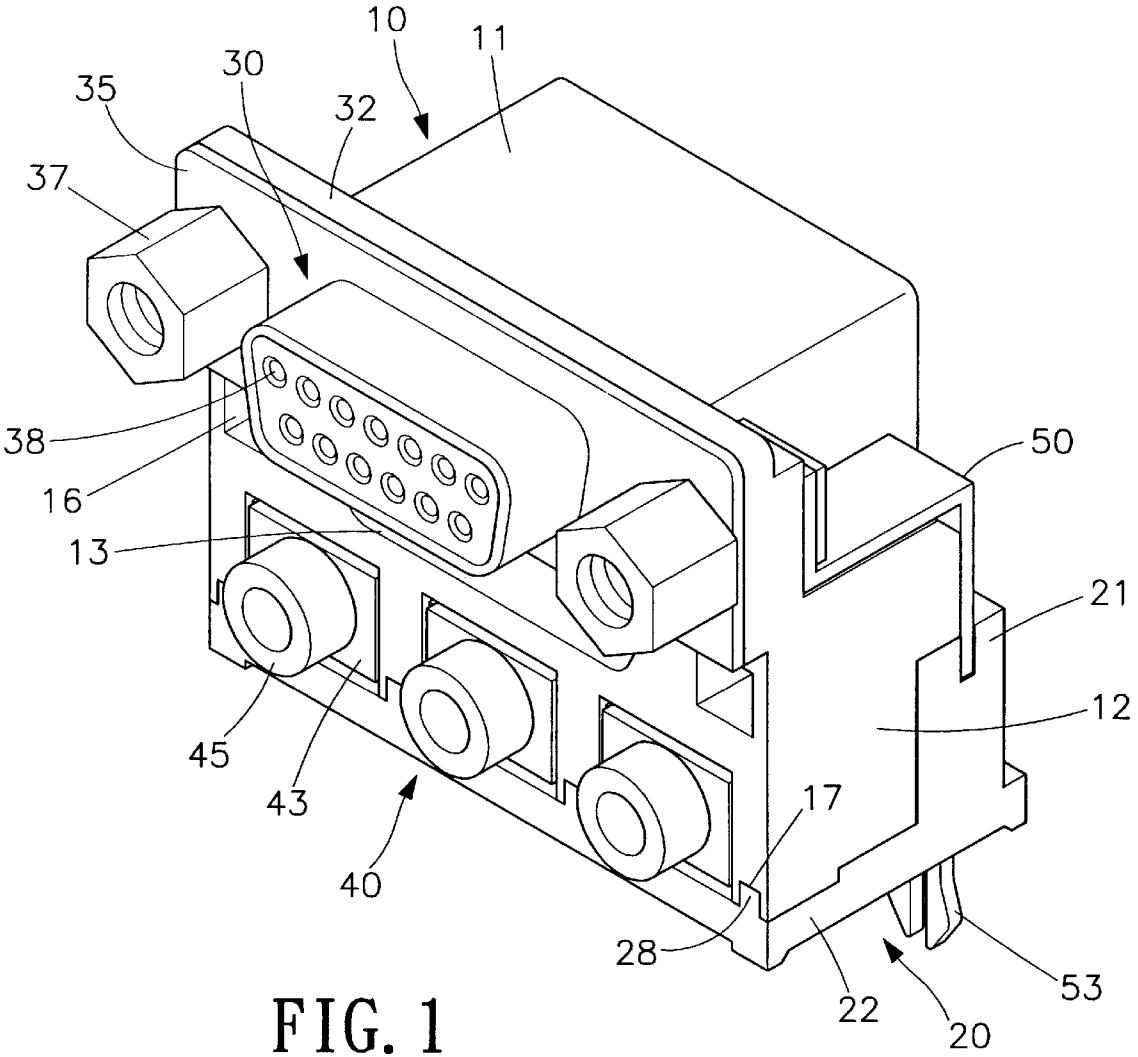
FIG. 1 shows a perspective view of the connector structure of the present invention.
Figure 2:
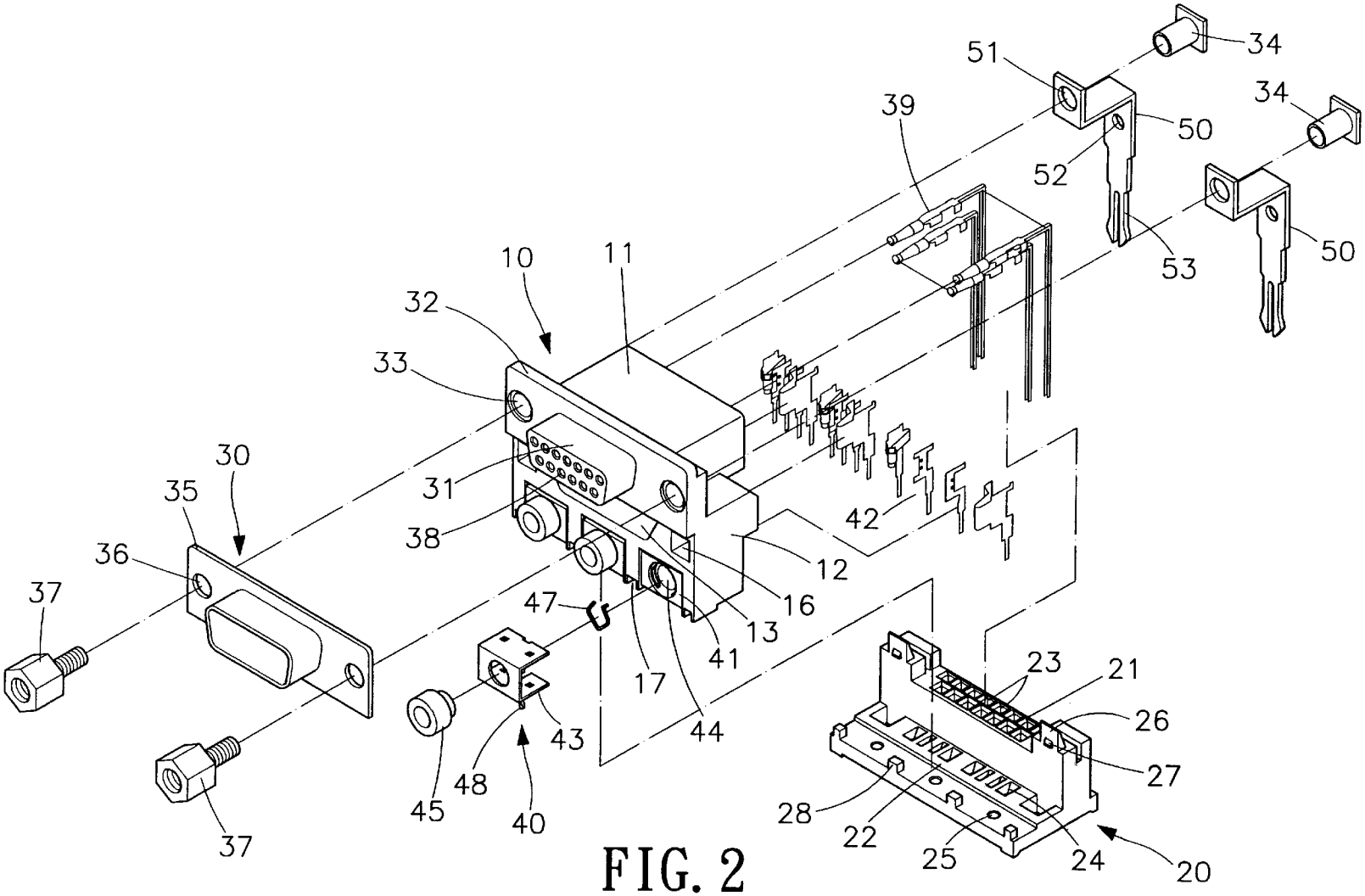
FIG. 2 is an exploded view of the connector structure of the present invention.
Figure 3:
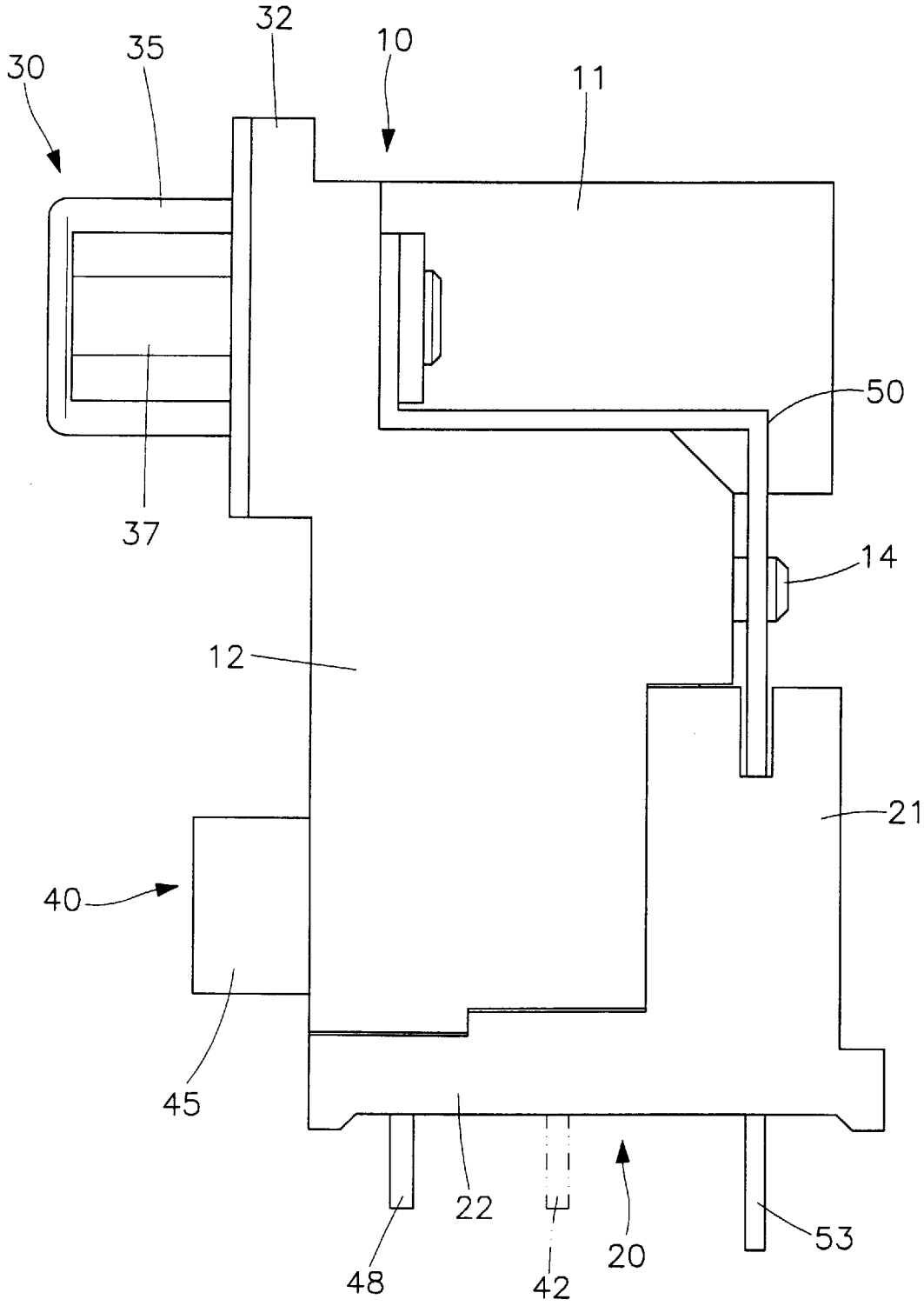
FIG. 3 is a side view of the connector structure of the present invention.
Figure 4:
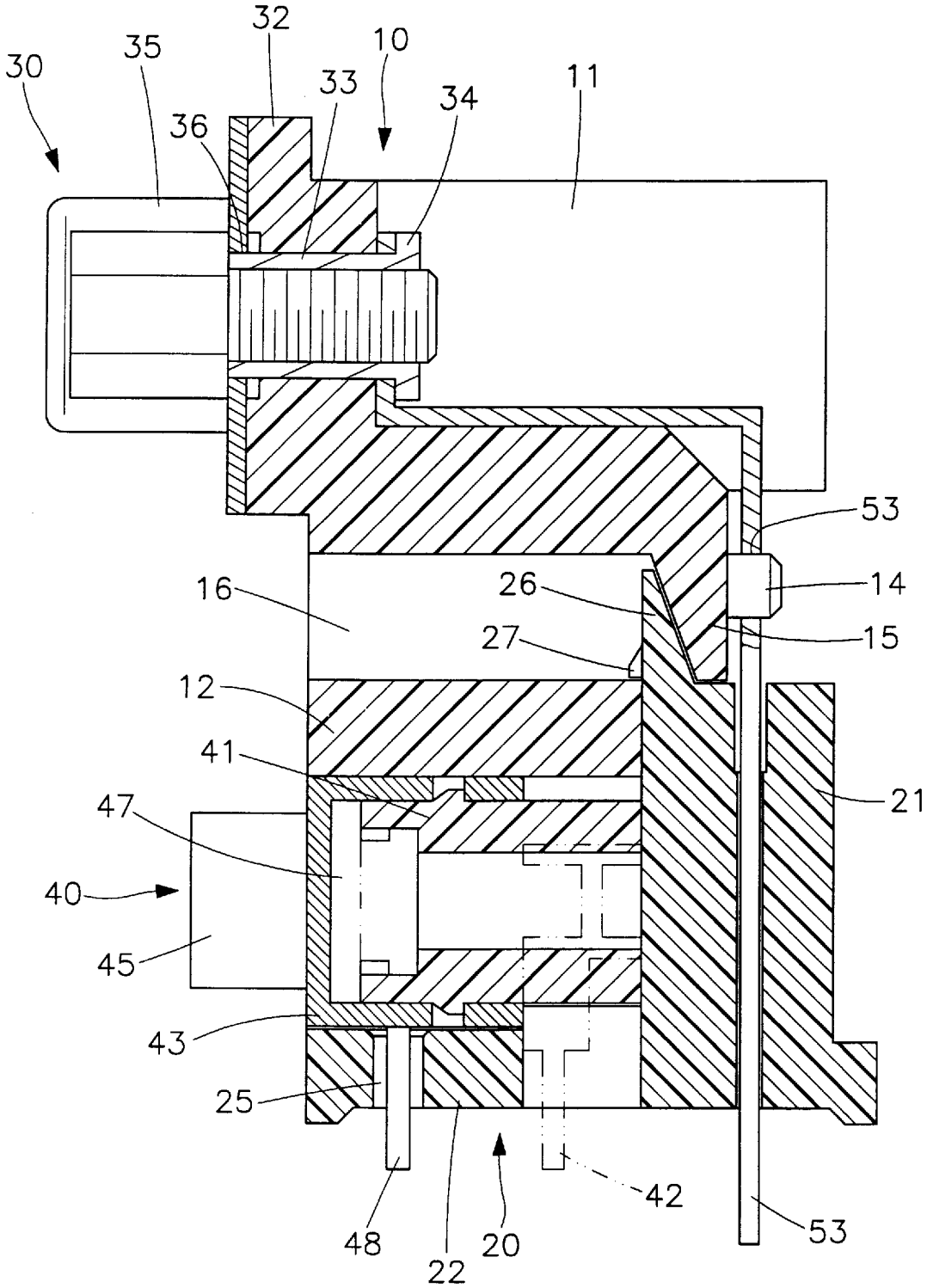
FIG. 4 is a cross section view of the connector structure of the present invention.
Figure 5:
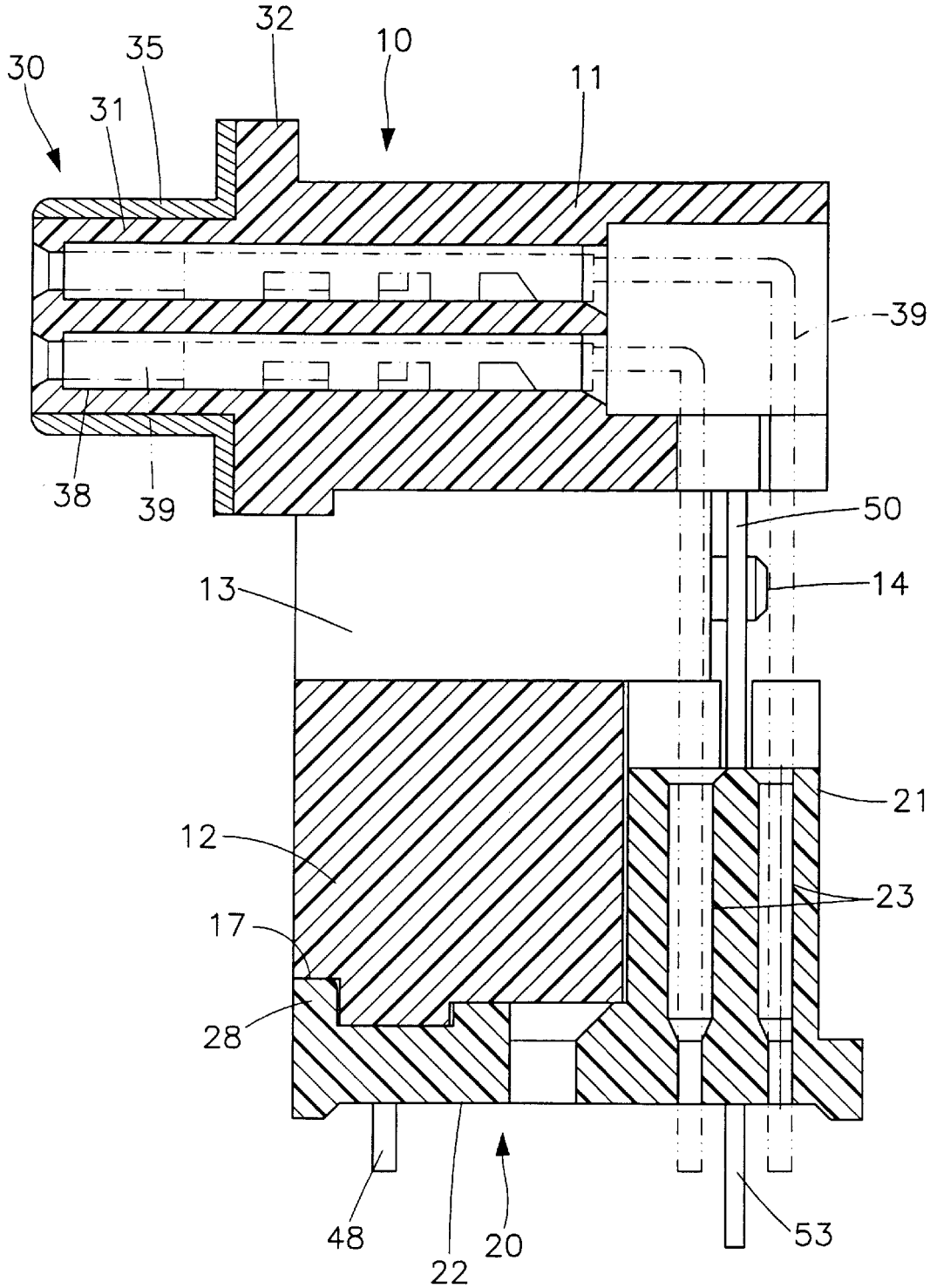
FIG. 5 is another cross section view of the connector structure of the present invention; and, FIG. 6 is a front view of the insulating body of the present invention.

As shown in FIGS. 1, 2, and 3, the connector of the present invention includes an insulating body 10, a seat 20, at least a first connector 30, and at least a second connector 40. The insulating body 10 is divided into a fast restoring power supply first body 11 and a second body 12, while a hollow portion 13 is formed between the first body 11 and the second 12 (as shown in FIG. 5) in order to save material cost. A pair of engaging holes 16 (as shown in FIG. 4) are formed at the front of the insulating body 10, each engaging hole 16 being spaced a proper distance from a respective side of the hollow portion 13. Two engaging bodies 15 with an inclining front surface are installed at the two sides of the rear end of the first body 11. A pillar 14 is formed on the rear end of the engaging body 15. A plurality of engaging grooves 17 are formed on the lower edge of the second body 12.

The seat 20 made from an insulating material, is attached to the lower portion of the insulating body 10 and has an L shape. A first portion 21 and a second portion 22 with different elevation levels are formed on the rear side and front side of the seat 20 respectively. The first portion 21 is higher than the second portion 22 and includes a plurality of terminal grooves 23 for passing conducting terminals 39 of the first connector 30 therethrough. The lower second portion 22 includes a plurality of terminal grooves 24 for allowing conducting terminals 42 of the first connector 40 to pass therethrough, and terminal grooves 25 for engaging the grounding piece 43. An engaging body 26 with an oblique rear plane is projected from each of the top portions of the two sides of the first portion 21, while a hook 27 is formed on the front end of the engaging body 26. A plurality of connecting bodies 28 are formed on the top of the front end of the second portion 22 of the seat 20. The seat 20 is matched with the lower portion of the insulating body 10, and the lower portion of the insulating body 10 is supported on the top surfaces of the first portion 21 and the second portion 22 of the seat 20. The connecting bodies 28 of the seat 20 may match with the engaging grooves 17 of the insulating body 10 so that the engaging body 26 of the seat 20 may engage with the engaging body 15 of the insulating body 10. The two hooks 27 of the seat 20 engage the rear end of the engaging holes 16 of the insulating body 10 so that the insulating body 10 and the seat 20 may be secured each to the other to form an assembly.

The first connector 20 is a D type connector, which has an insulating housing 31 integrally formed on the insulating body 10. A plate 32 is formed on the rear end of the insulating housing 31 and through holes 33 are installed on the two sides of the plate 32 for receiving rivet engaging pieces 34. A metal shell 35 is secured to the front end of the plate 32. On the two sides of the metal shell 35 are defined through holes 36 in alignment with the through holes 33 on the two sides of the plate 32. The through holes 33 on the two sides of the plate 32 allow for two rivet engaging pieces 34 to pass therethrough. The metal shell 35 and the plate 32 may be connected each to the other by passing the rivet engaging pieces 34 through the holes 33 and 36 for threadedly engaging with the threaded connecting pieces 37. A plurality of channels 38 extend within the insulating housing 31 through the first body 11 of the insulating body 10. Each of the channels 38 is matched with a conducting terminal 39 the lower end of which is protruded outside of the first body 11 and extends downwardly to match with the terminal grooves 23 of the first portion 21 of the seat 20. The lower ends of the conducting terminals 39 protrude through the lower portion of the seat 20 to provide electrical connection with a printed circuit board (not shown).

Figure 6:
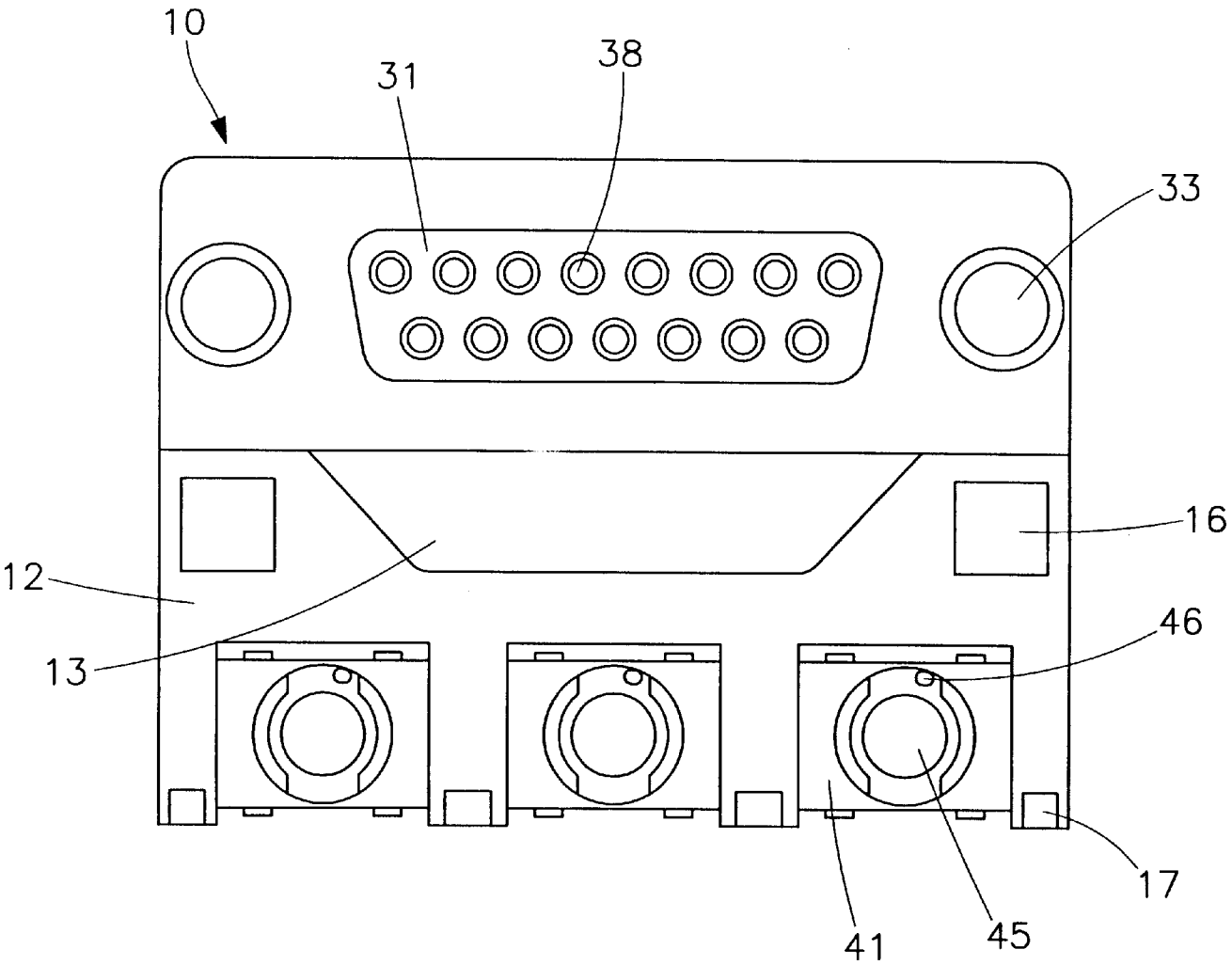

The second connector 40 is a set of audio plugs, which is formed by a plurality of insulating housings 41, conducting terminals 42 and grounding pieces 43. Each insulating housing 41 is integrally formed on the insulating body 10. Each insulating housing 41 has a through hole (channel) 44 extending rearwardly through the second body 12 of the insulating body 10. A plurality of conducting terminals 42 are received within the channels 44 of the insulating housings 41. The lower ends of the conducting terminals 42 are projected through the lower portion of the insulating body 10, and are received within the terminal grooves 24 of the second portion 22 of the seat 20. The conducting terminals 42 extend through the lower portion of the seat 20 for being electrically connected with a printed circuit board (not shown). Each of the insulating housings 41 receives a grounding piece 43 in the front end thereof. A cylindrical connecting portion 45 is installed through the front end of the grounding piece 43 into the channel 44. A fixing hole 46 (as shown in FIG. 6) is provided at the front end of the through hole (channel) 44 for receiving an angled end of an elastic clamping ring 47 therein, so that the clamping ring may be fixedly connected to the front end of the through hole 44. Thus the clamping ring 42 may clamp the respective connector elastically. A part of the pin 48 on the lower end of the grounding piece 43 protrudes outwardly to the lower portion of the insulating housing 10 and engages the terminal grooves 25 of the second portion 22 of the seat 20. The pin 48 is further protruded through the lower portion of the seat 20.

A buckling element 50 is fixedly connected on the two sides of the insulating body 10 so that the connector may be installed on a printed circuit board by buckling. Each of upper ends of the buckling element 50 has a connecting hole 51 for passing the rivet engaging pieces 34 therethrough so that two buckling elements 50 may be secured to the insulation body 10. Each of the buckling elements 50 has a connecting hole 52 aligned with the pillar 14 of the insulating body 10. The buckling elements 50 may be engaged with the pillars 14 through the connecting holes 52 so that the buckling elements 50 may be steadily secured on the insulating body 10. Each of the lower ends of the buckling elements 50 has a buckling connecting portion 53 for being fixed on a printed circuit board. By the aforementioned structure, a connector structure may be assembled.

In the structure of the connector of the present invention, the insulating housing 31 of the first connector 30 and the insulating housing 41 of the second connector 40 are integrally formed on the insulating body 10 so that the whole structure is simplified and is easy to be assembled. Thus the costs of the module, manufacturing, and finishing are greatly reduced. The maintenance and updating of the components are easily performed.

In summary, in the connector of the present invention, the deficiencies of the prior art have been overcome. Although a preferred embodiment of the present invention has been shown and described in detail, it should be understood that various changes modifications may be made therein without departing from the scope of the appended Claims.

What is claimed is:

1. A connector structure, comprising:

(a) an insulating body having at least a first connector housing and at least a second connector housing integrally formed as a single piece, said first connector housing having a plurality of first channels extending therein and said second connector housing having a plurality of second channels extending therein, said insulating body having a pair of engaging holes respectively formed therein adjacent two lateral sides thereof, said first connector housing having a pair of laterally spaced first engaging bodies extending from a rear end thereof, each of said first engaging bodies having a front oblique surface, said second connector housing having a plurality of engaging grooves formed adjacent a front portion thereof;

(b) a plurality of first and second conducting terminals, each of said first and second conducting terminals having a contact portion and a tail portion, said contact portions of said first and second conducting terminals being received within said first and second channels, respectively; and (c) a seat member removably secured to said insulating body at a lower end thereof, said seat member having a pair of second engaging bodies respectively formed adjacent two lateral sides thereof, each of said second engaging bodies having a rear oblique surface engaging said front oblique surface of a respective one of said first engaging bodies, each of said second engaging bodies having hook extending from a front surface thereof for engagement with a respective one of said engaging holes of said insulating body, said seat member having a plurality of connecting bodies formed at a front portion thereof in aligned relationship with said plurality of engaging grooves and respectively engaged therewith, said seat member having a plurality of first and second terminal grooves extending therethrough, said tail portions of said first and second conducting terminals passing through said first and second terminal grooves in said seat member, respectively.

2. A connector structure, comprising:

(a) an insulating body having integrally formed therein at least a first connector housing and at least a second connector housing, said first connector housing having a plurality of first channels extending therein and said second connector housing having a plurality of second channels extending therein, said insulating body further including:

a front portion and a rear portion thereof, a pair of engaging holes, each of said pair of engaging holes being located at said front portion in proximity to a respective side of said insulating body, a pair of first engaging bodies, each of said pair of engaging bodies having a front oblique surface, each said first engaging body being installed at said rear portion of said insulating body in proximity to a respective side thereof, and a plurality of engaging grooves formed at said front portion of said insulating body adjacent to said one end thereof;

(b) a plurality of first and second conducting terminals, each of said first and second conducting terminals having a contact portion and a tail portion, said contact portions of said first and second conducting terminals being received within said first and second channels, respectively; and (c) a seat member removably secured to said insulating body at one end thereof, said seat member having a plurality of first and second terminal grooves extending therethrough, said tail portions of said first and second conducting terminals passing through said first and second terminal grooves in said seat member, respectively, said seat member further including:

a first portion and a second portion, said first terminal grooves extending through said first portion of said seat member, and said second terminal grooves extending through said second portion of said seat member, a pair of second engaging bodies, each having an oblique rear surface engaging said front oblique surface of a respective one of said first engaging bodies on said insulating body, each said second engaging body being formed at an upper end of said first portion of said seat member adjacent to a respective side thereof, a pair of hooks, each of said hooks being formed at a front surface of each said second engaging body, each said hook engaging said insulating body at a respective one of said engaging holes, and a plurality of connecting bodies positioned at a front edge of said second portion of said seat member in spaced relationship, each of said connecting bodies engaging a respective one of said engaging grooves formed at said front portion of said insulating body.

3. A connector structures comprising:

an insulating body having integrally formed therein at least a first connector housing and at least a second connector housing, said first connector housing having a plurality of first channels extending therein and said second connector housing having a plurality of second channels extending therein;

a plurality of first and second conducting terminals, each of said first and second conducting terminals having a contact portion and a tail portion, said contact portions of said first and second conducting terminals being received within said first and second channels, respectively;

a seat member removably secured to said insulating body at one end thereof, said seat member having a plurality of first and second terminal grooves extending therethrough, said tail portions of said first and second conducting terminals passing through said first and second terminal grooves in said seat member, respectively;

a grounding piece installed within said at least one second connector housing;

a clamping ring element having an angled end thereof; and a fixing hole defined at a front edge of each of said second channels extending within said at least second connector housing, said clamping ring element being installed within said grounded piece at said front edge of each said second channel with said angled end of said clamping ring element engaged within said fixing hole.

* * * * *